US009522510B2

(12) United States Patent
Robinson, III et al.

(10) Patent No.: US 9,522,510 B2
(45) Date of Patent: Dec. 20, 2016

(54) SYSTEM AND METHOD FOR CONTROLLING WEB OUTPUT IN AN ENVELOPE PROCESSING APPARATUS

(71) Applicant: Tension International, Inc., Kansas City, MO (US)

(72) Inventors: Lon S. Robinson, III, Independence, MO (US); Edward Kishinevsky, Overland Park, KS (US)

(73) Assignee: Tension International, Inc., Kansas City, MO (US)

( * ) Notice: Subject to any disclaimer, the term of this patent is extended or adjusted under 35 U.S.C. 154(b) by 687 days.

(21) Appl. No.: 13/859,532

(22) Filed: Apr. 9, 2013

(65) Prior Publication Data

US 2013/0267400 A1 Oct. 10, 2013

Related U.S. Application Data

(60) Provisional application No. 61/621,853, filed on Apr. 9, 2012.

(51) Int. Cl.
*B31B 19/20* (2006.01)

(52) U.S. Cl.
CPC ..... *B31B 19/20* (2013.01); *B31B 2219/145* (2013.01); *B31B 2219/6007* (2013.01);
(Continued)

(58) Field of Classification Search
CPC ..... B31B 19/20; B31B 2219/6007; B31B 2219/9045; B31B 2219/9048; B31B 2219/145
See application file for complete search history.

(56) References Cited

U.S. PATENT DOCUMENTS 3,140,816 A 7/1964 Schultz
3,982,472 A 9/1976 Howatt
(Continued)

FOREIGN PATENT DOCUMENTS

WO 0058165 A2 10/2000
WO 2013155096 A1 10/2013

OTHER PUBLICATIONS

International Search Report; PCT/US2013/035820; Mailed Oct. 17, 2013.
(Continued)

*Primary Examiner* — M. N. Von Buhr
(74) *Attorney, Agent, or Firm* — Polsinelli PC; Marcia J. Rodgers; Derek D. Donahoe

(57) ABSTRACT

A system for processing a continuous web of envelope stock includes a web aligner, infeed nip including a load cell, rotary cutter, gummer, patch applicator, buffer, and control system. Gummer nozzles are actuated to apply patterns of adhesive to the moving web in surrounding relation to window apertures. A method for controlling the web output rate from the system includes receiving at the control system an input web tension indicator from the nip load cell, receiving an output web tension indicator from a transducer at system output, comparing the received indicators and transmitting a control signal to actuate a roller assembly between the infeed nip and the transducer to increase or decrease speed to adjust web tension. The control system also transmits a web input speed control or stop signal based on the calculated capacity percentage of web accumulated in the buffer, which is determined with reference to a threshold value.

16 Claims, 10 Drawing Sheets

(52) U.S. Cl.
CPC ..... *B31B 2219/9045* (2013.01); *B31B 2219/9048* (2013.01)

(56) References Cited

U.S. PATENT DOCUMENTS

| | | | | |
|---|---|---|---|---|
| 4,100,012 | A * | 7/1978 | Meihofer | B65H 23/1888 156/351 |
| 4,233,104 | A * | 11/1980 | Fujishima | B65H 19/10 156/504 |
| 4,416,651 | A | 11/1983 | Sullivan et al. | |
| 4,549,917 | A | 10/1985 | Jensen, Jr. | |
| 2,703,043 | A | 3/1995 | Novick et al. | |
| 5,524,548 | A | 6/1996 | Fox | |
| 5,640,831 | A | 6/1997 | Harrod et al. | |
| 5,782,156 | A | 7/1998 | Collins | |
| 6,092,002 | A * | 7/2000 | Kastman | A61F 13/15772 156/229 |
| 6,856,850 | B2 | 2/2005 | Rajala et al. | |
| 7,171,283 | B2 * | 1/2007 | Popp | G05B 19/042 162/273 |
| 7,413,139 | B2 * | 8/2008 | Benvenuti | B65H 23/048 242/421.1 |
| 7,458,540 | B2 * | 12/2008 | Weber | B65H 20/34 242/417.2 |
| 8,007,425 | B2 | 8/2011 | Scheu | |
| 8,087,220 | B2 | 1/2012 | Uttaro et al. | |
| 8,398,808 | B2 * | 3/2013 | Grohmann | B23P 19/047 156/166 |
| 2002/0166636 | A1 | 11/2002 | Okushita et al. | |
| 2004/0108052 | A1 | 6/2004 | Haga et al. | |
| 2010/0282406 | A1 | 11/2010 | Kitada et al. | |

OTHER PUBLICATIONS

Written Opinion; PCT/US2013/035820; Mailed Oct. 9, 2014.
International Preliminary Report on Patentability; PCT/US2013/035820; Mailed Oct. 14, 2014.
Coast Controls Brochure; All-Air Web Guiding Systems, 2013.
Dover Flexo Electronic Website: http://www.dfe.com/index.html.
Kocher-Beck Website: http://kocher-beck.com/product-solutions/rotary-dies/.
ITW Dynatec Installation Diagram, Jun. 2004.

* cited by examiner

SYSTEM AND METHOD FOR CONTROLLING WEB OUTPUT IN AN ENVELOPE PROCESSING APPARATUS

CROSS-REFERENCE TO RELATED APPLICATIONS

This application claims priority under 35 U.S.C. 119(e) and 37 C.F.R. 1.78(a)(4) based upon U.S. Provisional Application Ser. No. 61/621,853 for WINDOW PROFILING SYSTEM filed Apr. 9, 2012, which is incorporated herein in its entirety by reference.

FIELD

The present disclosure relates to an envelope processing apparatus. More particularly, it is concerned with an automated window profiling apparatus for a continuous web of envelope roll stock that can be subsequently fed into an apparatus such as an inserter or the like for further processing.

BACKGROUND

Commercial mail production involves continuous, automated insertion of preprinted content, such as product advertising and marketing materials, bank statements and invoices, into envelopes for bulk mailing. The envelopes may be manufactured off site and provided in bulk for insertion. Alternatively, envelope web stock may be supplied in roll form and wrapped or folded around the insert material, followed by gluing and cutting into individual units for mailing. This method is particularly desirable because envelope roll stock is economical to obtain, store and use, and a single-line, automatic envelope production and insertion process is potentially more efficient than previous methods. However, such methods have not been fully successful for all types of business uses because the resulting mailing pieces tend to resemble folded self-mailers rather than formal business envelopes.

In addition, inserter equipment that handles inserts consisting of multiple pages is subject to work flow hesitation, while the inserter waits for the pages to be accumulated for insertion. This hesitation is exacerbated when the inserts are not uniform and the number of pages to be inserted varies from envelope to envelope. This may result in periodic stoppage of the upstream portion of the inserter while it waits for additional pages to accumulate for insertion. When such hesitation or stoppage occurs, the inserter apparatus may be temporarily unable to accept input of new envelope stock from an upstream station.

This inherent variability of inserter throughput has prevented the use of roll form envelope web stock to form window envelope stock for use in wrapper and inserter systems because the window cutting and patching operations are generally intolerant of interruption. For example, water-based window patch adhesives generally require curing over a period of time that is incompatible with automatic wrapping and insertion operations. Additionally, no process has been available to efficiently convert envelope stock by cutting or profiling and patching windows because no apparatus or method has been available to precisely apply available alternate adhesives in the open rectangular pattern necessary to completely surround the envelope window.

Accordingly, there exists a need for an improved window profiling system having a series of components that can receive a continuous web of envelope stock from a roll, align the web, measure the tension on the web and relay the information to a control system, cut window apertures and trim the seal flaps at predetermined locations to form a continuous web of window-apertured envelope blanks, apply an adhesive in surrounding relation to the window apertures, cut a web of window film to preselected lengths to form window patches, apply the window film patches in registration with the adhesive patterns on the envelope web, and control the output speed of the patched window envelope web in response to input availability data obtained from a downstream apparatus such as a wrapper, inserter or the like. This disclosure addresses this need in the art as well as other needs, which will become apparent from the following disclosure.

SUMMARY

The present disclosure provides a greatly improved profiling system for window envelopes that aligns a continuous web of roll stock, controls the speed and tension on the web, performs cutting operations on the web to cut envelope window and seal flap profiles and remove the blanks, applies an adhesive composition to a surface of the web in surrounding relation to each window perimeter, cuts patches from a web of window film, the patches sized to correspond with the size of the window openings as well as a predetermined overlap, applies the window film patches in registration with the adhesive patterns around the window apertures, and controls the web output speed to a receiving apparatus in response to input availability data received from the receiving apparatus.

In one embodiment, the window profiling system also includes a vacuum magnetic cutting cylinder equipped with a flexible die configured for cutting a rectangular window from the envelope web. The cylinder includes vacuum holes for holding the cutout portion of the web against the cylinder as it rotates. A stream of compressed air delivered through the vacuum holes releases the cutout at a collection location.

In another embodiment, the window profiling system includes an adhesive applicator unit having a template. The template includes multiple lanes configured to direct an adhesive composition in a predetermine pattern in precise, surrounding relation to the window aperture.

Various objects and advantages of this window profiling system will become apparent from the following description taken in conjunction with the accompanying drawings wherein are set forth, by way of illustration and example, certain embodiments of this system.

The drawings constitute a part of this specification, include exemplary embodiments of the window profiling system, and illustrate various objects and features thereof.

DETAILED DESCRIPTION

As required, detailed embodiments of the present window profiling system and method are disclosed herein; however, it is to be understood that the disclosed embodiments are merely exemplary of the system, which may be embodied in various forms. Therefore, specific structural and functional details disclosed herein are not to be interpreted as limiting, but merely as a basis for the claims and as a representative basis for teaching one skilled in the art to variously employ the system in virtually any appropriately detailed structure.

Figure 1:
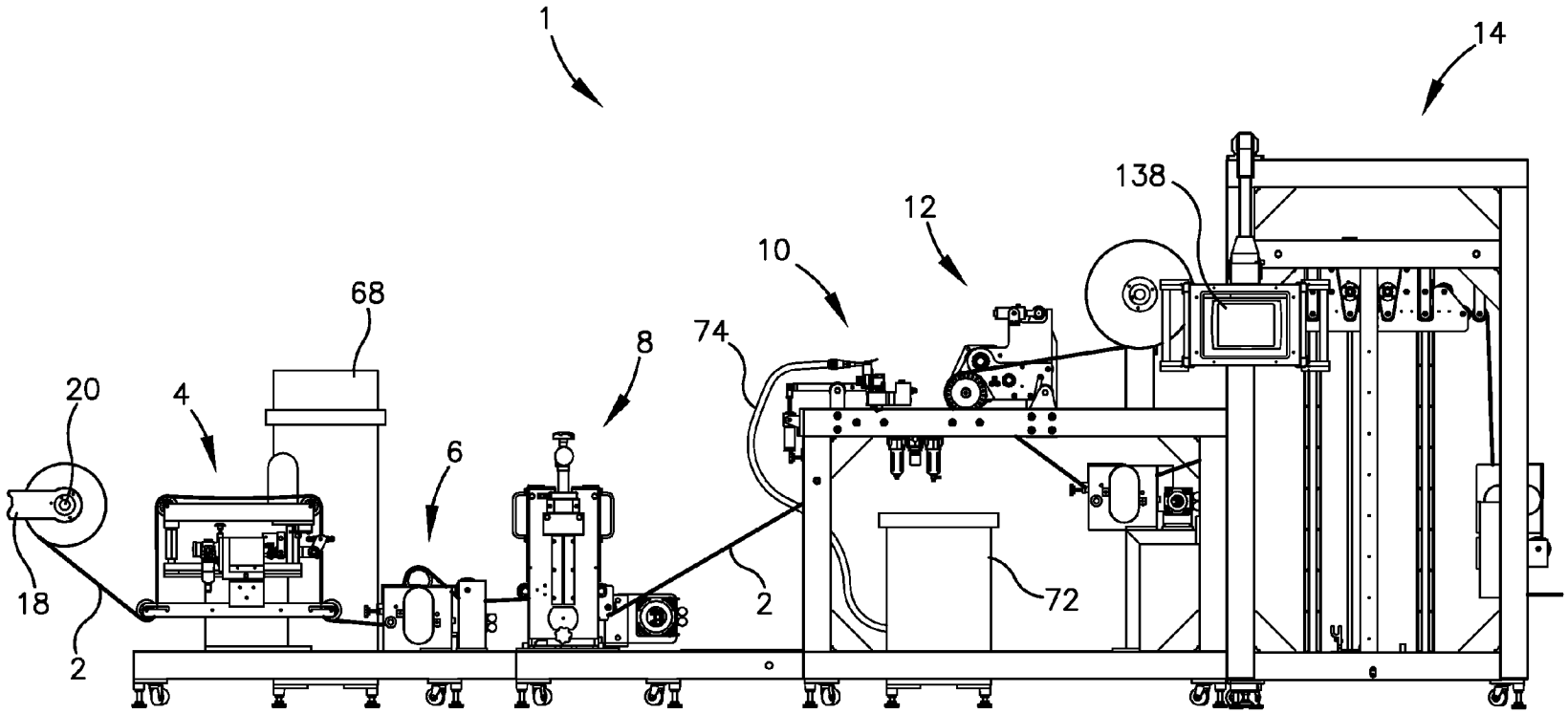
FIG. 1 is a side elevational view of a window profiling system in accordance with the disclosure.

Referring now to the drawing figures, the reference numeral 1 refers to a window profiling system, which is depicted in FIG. 1 in association with a web 2 of roll stock in accordance with a first embodiment of the present disclosure. Advantageously, the system 1 can shape the web into a plurality of interconnected envelope blanks, cut window openings at preselected locations in the blanks, precisely apply adhesive to the web surface in a pattern in surrounding relation to the openings, apply window patches in registration with the adhesive patterns and coordinate and control the rate of the process so that the output of the converted web matches the input requirements of a second web processing apparatus. Where the second processing apparatus is subject to starts and stops, as, for example, an inserter apparatus, the system can automatically control the output of the converted web to avoid shutdown.

Figure 12:
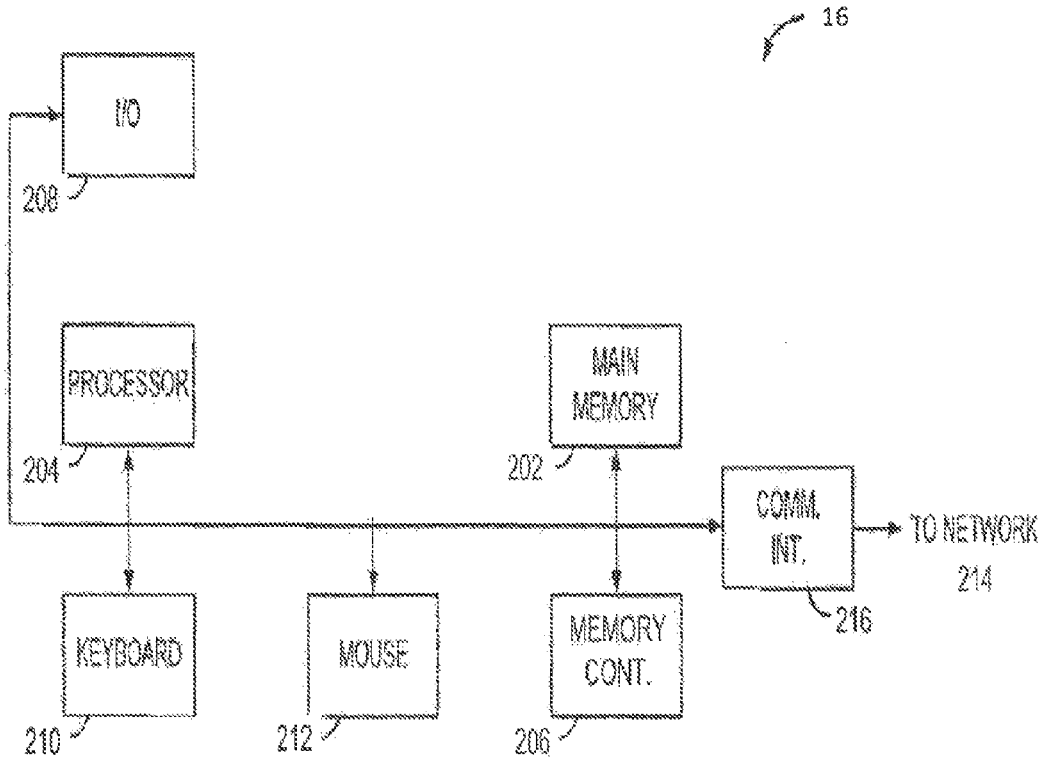
FIG. 12 is a diagram of the control system.

The system 1 includes a web alignment assembly 4, infeed nip assembly 6, cutting assembly 8, gumming assembly 10, patch applicator assembly 12, buffer assembly 14, and a control system 16 (illustrated in FIG. 12). The control system 16 is in electrical communication with each of the foregoing assemblies except the web alignment assembly 4 and gumming assembly 10, either through wired or wireless communication, to receive one or more signals associated with the performance, position or status of the components of the system.

Figure 2:
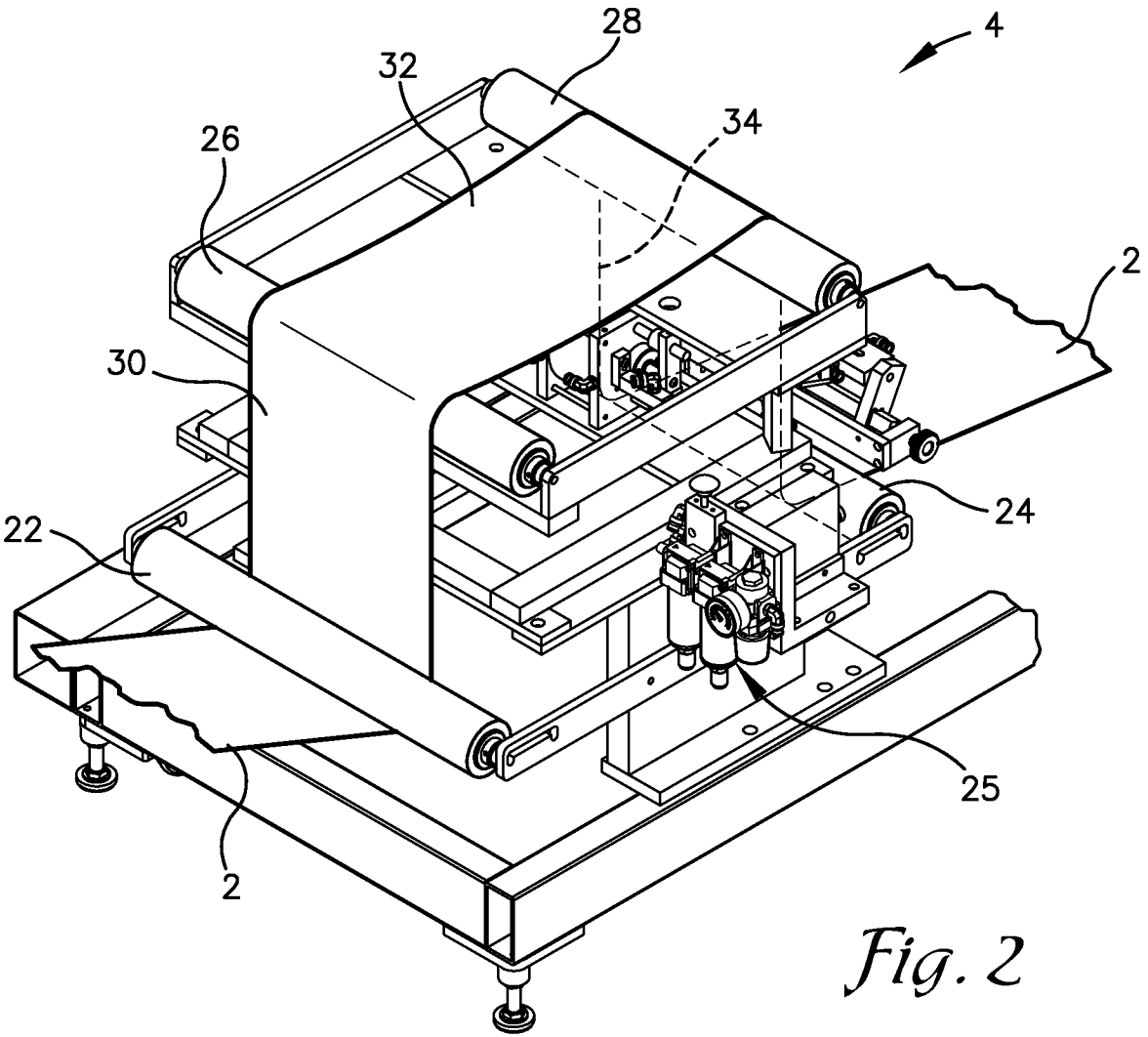
FIG. 2 is an enlarged perspective view of the web alignment assembly shown in FIG. 1.

A laterally shiftable roll stand 18 (FIG. 1A) supports the roll stock web 2 on a spindle 20 so that the web 2 is dispensed in a counterclockwise manner to the web alignment assembly or web aligner 4. The web 2 may be formed of any natural or synthetic substrate stock material, such as a paper, film or foil that is suitable for use in forming an envelope, mailer or other packaging piece. The web is guided and maintained in precise lateral alignment by an internal web aligner or guide 4 which includes a steering mechanism, sensors and guidance system to maintain proper alignment of the continuous web for further processing. An exemplary web aligner is the RDG5 Custom Displacement Guide produced by Coast Controls, Inc., Sarasota, FL, although any other suitable web alignment apparatus may be employed. The web aligner 4 is depicted in FIG. 2 to include entrance and exit rollers 22, 24 mounted in spaced, approximately parallel relation below respective first and second displacement guide rollers 26, 28. The web 2 passes beneath the entrance roller 22 and upward to the first displacement guide roller 26, in a web entry span 30, over the first and second displacement guide rollers 26, 28 in a guide span 32, and down to the exit roller 24 in an exit span 34. While the embodiment shown in FIG. 2 uses a pneumatic assembly 25 to sense and align the moving web 2, other types of web guide devices may also be used to sense the lateral position of the web 2 and automatically adjust the alignment. For example, web alignment devices that employ photodetectors, infrared, optical or other sensors in conjunction with a steering device such as a hydraulic cylinder or electric motor, or any other suitable web alignment control system may also be used.

Figure 3:
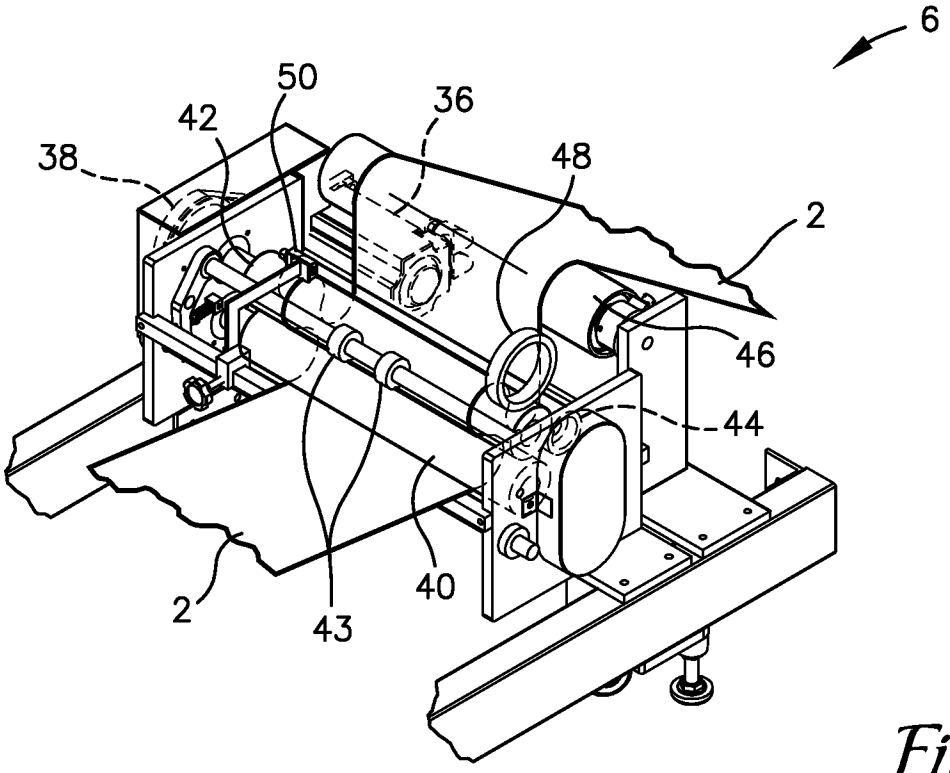
FIG. 3 is an enlarged perspective view of the infeed nip assembly shown in FIG. 1, depicted with a load cell.

The web exits beneath the exit roller 24 to the infeed nip assembly 6 shown in FIG. 3 as associated with or including a load cell 46. The infeed nip assembly 6 and load cell 46 cooperatively measure the running tension on the web as it passes through the system 1. In association with the buffer assembly 14 they also serve to cooperatively control the web tension. The infeed nip assembly 6 includes the major elements of a drive motor 36, idler roller 40, pull roller 42, a pair of nip rollers 43 and an idler roller 44. The web 2 exits the aligner 4 and proceeds to the infeed nip assembly 6 where it passes beneath the idler roller 40 and upwardly over the infeed pull roller 42, connected by a belt 38 to drive motor 36, The idler roller 40 includes a gripping surface that is constructed of rubber or other tacky material for gripping the web and passing it upwardly to the infeed pull roller 42 where it is contacted by the nip rollers 43, which hold the web against the roller 42 and pass it below the idler roller 44. The pull roller 42 creates tension on the web 2 that is subsequently monitored and controlled throughout the remainder of its passage through the window profiling system 1. An infeed surface speed sensor 48 engages the surface of the pull roller 42 to measure the running speed of the web 2. The surface speed sensor or encoder measures revolution of the pull roller 42 and transmits this information to a controller for the gumming assembly 10 as will be described in more detail. A cue mark sensor 50 is positioned adjacent the web as it passes over the infeed pull roller 42. The cue mark sensor 50 is an optical sensor that reads any cue marks that may have been preprinted on the web 2 for use in locating or positioning subsequent web conversion operations. Such cue marks may optionally be applied to the web and are particularly well suited to register applied printing with subsequent cutting operations.

The web proceeds upwardly from the idler roller 44 and over a web tension sensor-equipped idler roller or load cell 46, during which time the roller maintains pressure on the web 2. An exemplary load cell is manufactured by Dover Flexo Electronics, Rochester, N.H., although any suitable load cell may be employed. Internally mounted transducers or sensing elements (not shown) in the load cell 46 measure the web tension by measuring displacement of the floating roller in response to any increase in tension on the web. The internal transducer in the load cell 46 produces a signal output response that is proportional to the displacement of the floating roller. This response is transmitted to the control system 16, which measures the output and compares the tensioned value to a predetermined reference or set point. This comparison may involve application of an algorithm, such as, for example, a proportional-integral-derivative (PID) control algorithm. If necessary, the controller 16 generates a correction signal to actuate slowing of the drive motor 36, thereby braking the infeed pull roller 42 and slowing the speed of the web 2. The web exits over the load cell 46 and proceeds to the cutting assembly 8.

Figure 4:
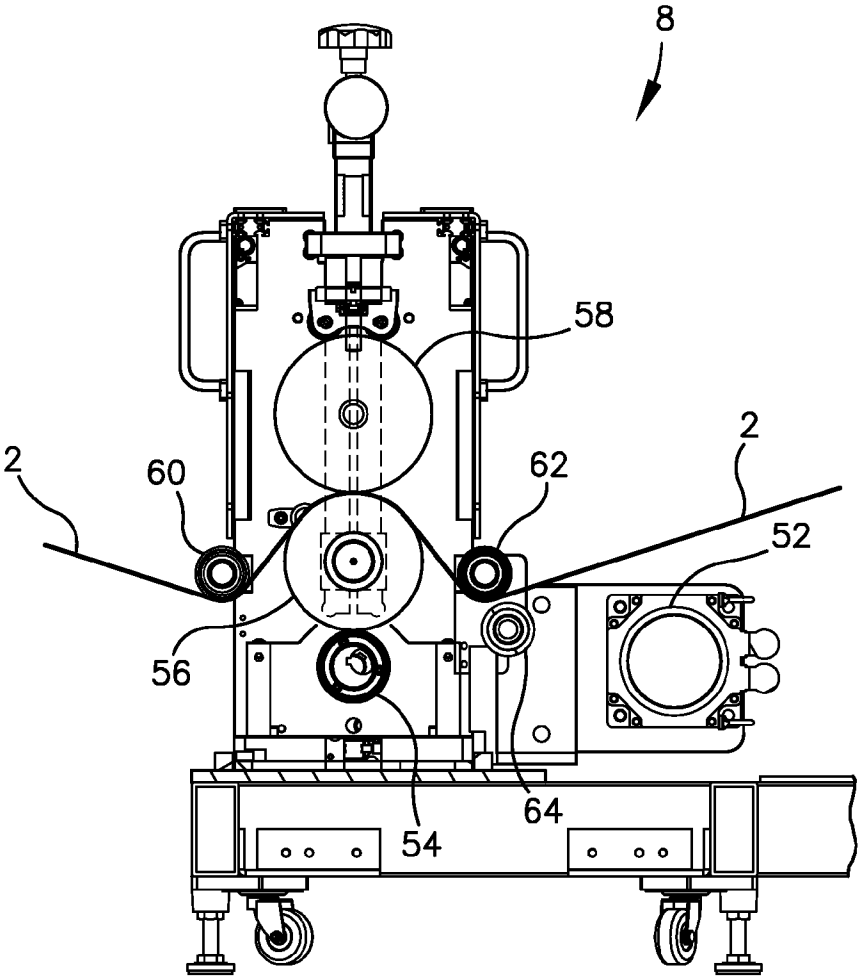
FIG. 4 is an enlarged side elevational view of the cutting assembly shown in FIG. 1.

The cutting assembly or station 8 as shown in FIG. 4 is a rotary device that employs flexible cutting dies. The assembly 8 includes a cutting assembly drive motor 52 connected to a driven roller 54 by a belt. The drive motor 52 is preferably a servo motor capable of receiving signals from the control system 16 and providing feedback regarding its speed. The driven roller 54 rotates an anvil cylinder 56. A cutting cylinder 58 is equipped with rotary dies and is positioned above the anvil cylinder 56. An exemplary rotary cutting assembly is produced by KOCHER+BECK, Lenexa, Kans. and provides for incremental adjustment of the gap between the anvil cylinder 56 and the cutting cylinder 58 to accommodate a variety of web thicknesses, although any suitable rotary cutting assembly may be employed.

Figure 5:
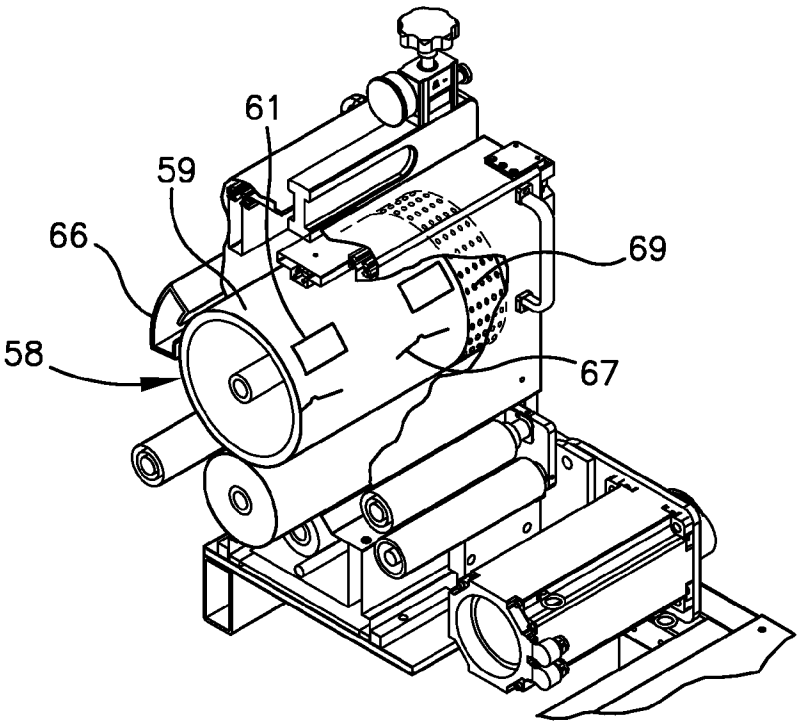
FIG. 5 is an enlarged perspective view of the cutting assembly shown in FIG. 4 with some parts broken away and other parts in sectional view to show details.
Figure 6:
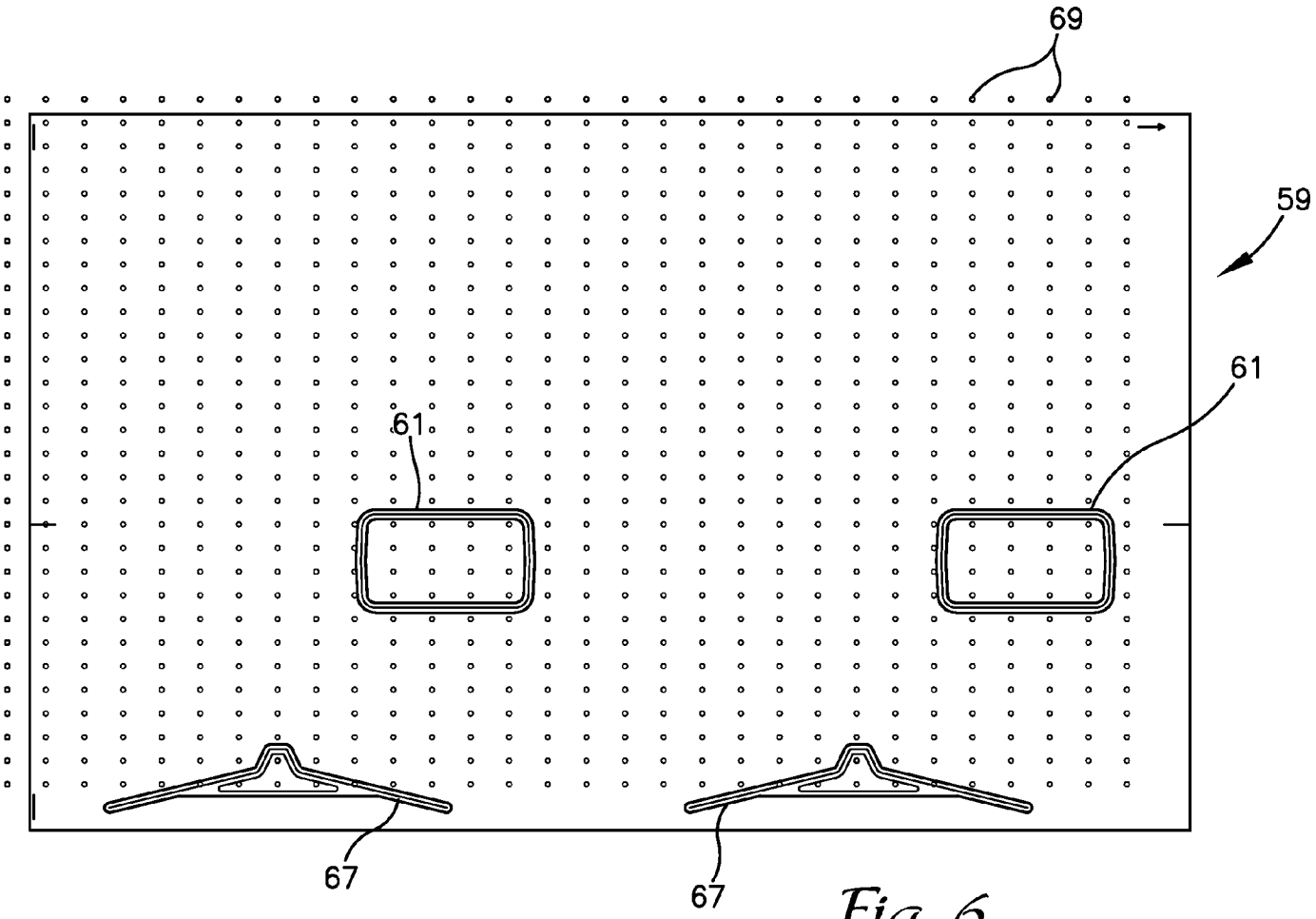
FIG. 6 is an enlarged top plan view of the flexible die showing the window profiling blades.

After the web passes from the infeed nip assembly 6 over the load cell 46, it passes beneath the infeed roller 60 of the cutting assembly 8, then between the anvil cylinder 56 and the cutting cylinder 58, which is equipped with a flexible cutting die 59 shown in FIG. 6. The cutting cylinder 58 is of the vacuum magnetic type and includes at least one internal axial vacuum channel and a hose coupling for receiving a conduit or vacuum hose connected to a remotely located vacuum unit 68 (FIG. 1). The axial vacuum channel is in communication with an arrangement of spaced apertures or holes 69 (FIGS. 5, 6) that are provided on the outer surface of the vacuum magnetic cutting cylinder 58. The cylinder 58 includes structure enabling various ones of the holes 69 to be closed off to form a predetermined area in which vacuum suction is not applied. An exemplary vacuum magnetic cylinder is described in U.S. Pat. No. 8,007,425, the entirety of which is incorporated herein by reference.

FIG. 6 illustrates an exemplary flexible die 59 for profiling two envelopes in side-by-side relation from a portion of the web 2. The die 59 is shown in superimposed relation over the holes of the vacuum cylinder 58 below. In other embodiments, the die 59 may be configured to profile 1, 3, 4, 5, 10 or any number of envelopes in a single rotation or pass over a portion or section of the web. The die 59 includes at least one window profiling area equipped with a raised cutting surface or blade 61 to cut the profile of an envelope window in the web. While the cutting surface 61 is depicted as having a generally rectangular overall configuration, it may have any suitable shape, such as a square or other quadrilateral, multilateral, circular, oval, multicurvate or compound linear and curvate configuration. The die 59 also includes one or more additional cutting surfaces or radius blades 67 for creating the profile of an envelope seal flap. The window cutting surface 61 and radius blades 67 cooperate to form the web into a continuous series of connected blanks for later forming into window envelopes. The flexible die 59 fits over the magnetic cylinder 58 with the raised window profile cutting surface 61 and the raised radius cutting surface 67 aligned with respective groups of vacuum holes 69. Vacuum suction holds the cut out portions of the web, or chips, against the vacuum cylinder 58 following the cutting operations.

Where the web contains printing, the cutting system 8 is actuated to cut in registry with the printing by a signal from the control system 16 in response to input from the cue mark sensor 50 in the infeed nip assembly 6. The control system 16 may be used to adjust the circumferential position of the cutting cylinder 58 to match the location of the printing in accordance with the sensed cue mark locations. As the web 2 advances through the cutting assembly 8, the cutting cylinder 58 rotates along the web to enable the window profiling blade 61 to cut out a window aperture at a preselected location on each envelope blank and the radius blade to cut out a seal flap profile at a preselected location on the web, thereby forming a window-profiled envelope blank. The flexible die 59 may also be configured for cutting out more than one window aperture and/or more than one seal flap profile in each envelope blank. As the web is cut, the window and seal flap chips are separated from the newly formed window and seal flap profile by adherence to the vacuum cylinder 58. The window and seal flap chips are attracted to the surface of the magnetic cylinder 58 through a predetermined pattern of actuated vacuum suction holes 69 corresponding to the shape of the chips. The chips are carried around the vacuum cylinder 58 to a predetermined location where the control system actuates delivery of a puff or stream of compressed air through the respective holes 69, which releases the chips from the cylinder. The chip release is timed by the control system to occur in the vicinity of an opening of the vacuum collector 66, which carries the chip away to the vacuum unit 68. This enables the windowed web 2 to advance to the subsequent work station for processing without interference from any loose chips. The web 2 exits the cutting station 8 below an exit roller 62 connected by a belt to a pull roller 64.

The computer control system 16 calculates the location of the cue marks on the web based on information provided by the cue mark sensor 50 and adjusts the position of the vacuum magnetic cylinder 58 accordingly so that a window will be precisely cut in the proper position, and compressed air supplied at the appropriate time to blow the chip off the cylinder for vacuum collection. The vacuum is actuated by the control system 16 to operate when the system 1 is energized and has been commanded to move forward. If the system 1 is not energized for a predetermined period of time, the control system 16 turns off the vacuum unit 68.

Figure 8:
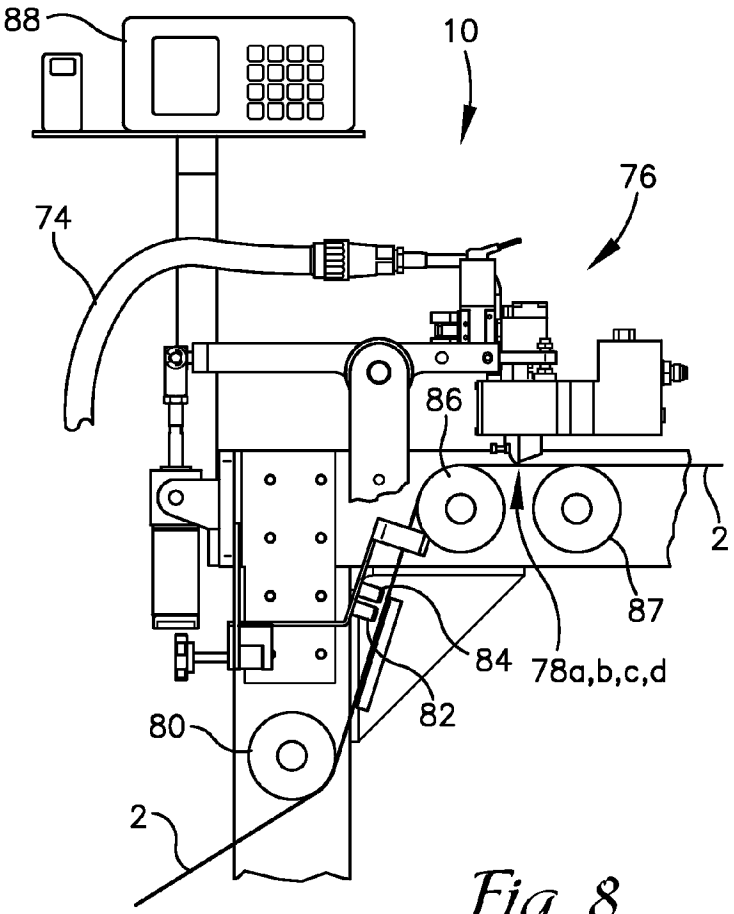
FIG. 8 is an enlarged side elevational view of the gumming assembly shown in FIG. 1.
Figure 7:
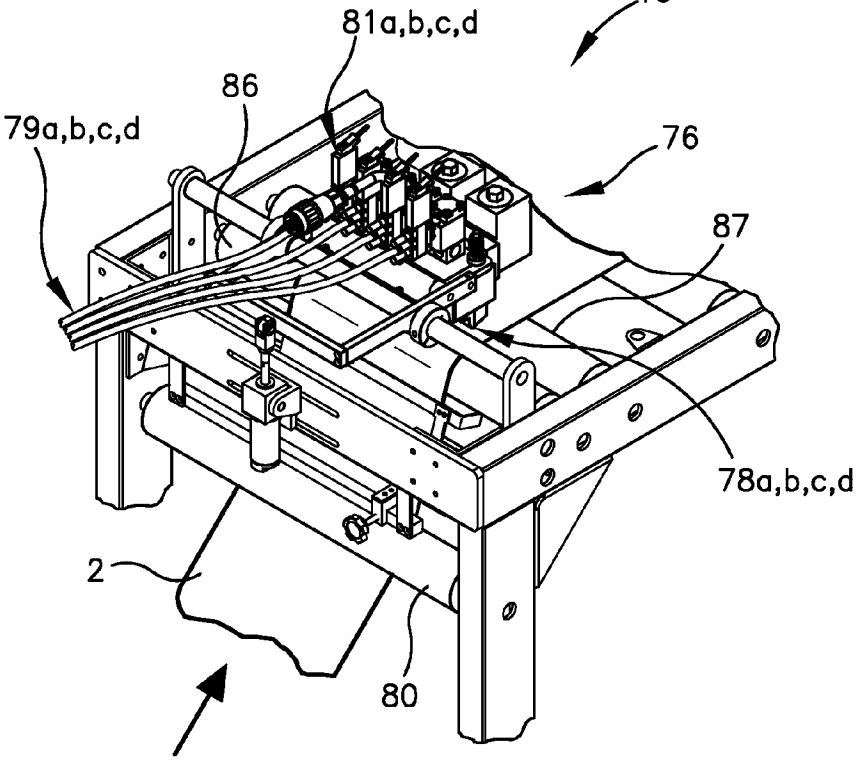
FIG. 7 is an enlarged partial perspective view showing details of the gumming assembly shown in FIG. 8.

The adhesive application or gumming assembly 10, shown in FIGS. 7 and 8, applies an adhesive composition in a pattern in surrounding relation to the shape of the window aperture that has been cut into the web 2 by the blade 61. In one embodiment, the assembly includes an adhesive melt unit 72 (FIG. 1), which is interconnected by one or more conduits or adhesive supply hoses 74 to an applicator unit 76 (FIG. 7). The hot melt unit 72 heats a selected solid adhesive composition, which may be a mixture, to a flowable form and pressurizes it to enable passage of the adhesive through the supply hose 74 (FIG. 1) to the applicator unit 76 (FIG. 8). Melting and output of the adhesive from the unit 72 is controlled by a pair of solenoids (not shown). The adhesive applicator unit 76 includes four applicator modules, each equipped with a nozzle 78*a*, 78*b*, 78*c* or 78*d* and air supply line 79*a*, 79*b*, 79*c* or 79*d* that are connected with a pneumatic or air compressor unit. The modules and nozzles may be arranged in any suitable manner for application of a glue pattern corresponding to the shape of the window aperture. The depicted embodiment includes an in-line arrangement of four modules for application of a generally rectangular glue pattern.

As best shown in FIGS. 7 and 8, each applicator module includes a solenoid 81*a*, 81*b*, 81*c*, or 81*d* which controls the output of hot melt adhesive through a respective valve to a dedicated nozzle 78*a*, 78*b*, 78*c* or 78*d*. Those skilled in the art will appreciate that as an alternative to the hot melt adhesive application method described herein, any suitable adhesive composition and method may be employed, such as, for example, a cold glue, an ultraviolet curable adhesive or mixture of adhesives may be employed. Components of the gumming assembly may be modified in accordance with equipment and application requirements for the preferred adhesive. In one embodiment employing a cold glue formulation, the glue is applied using a rotary plate.

Figure 9:
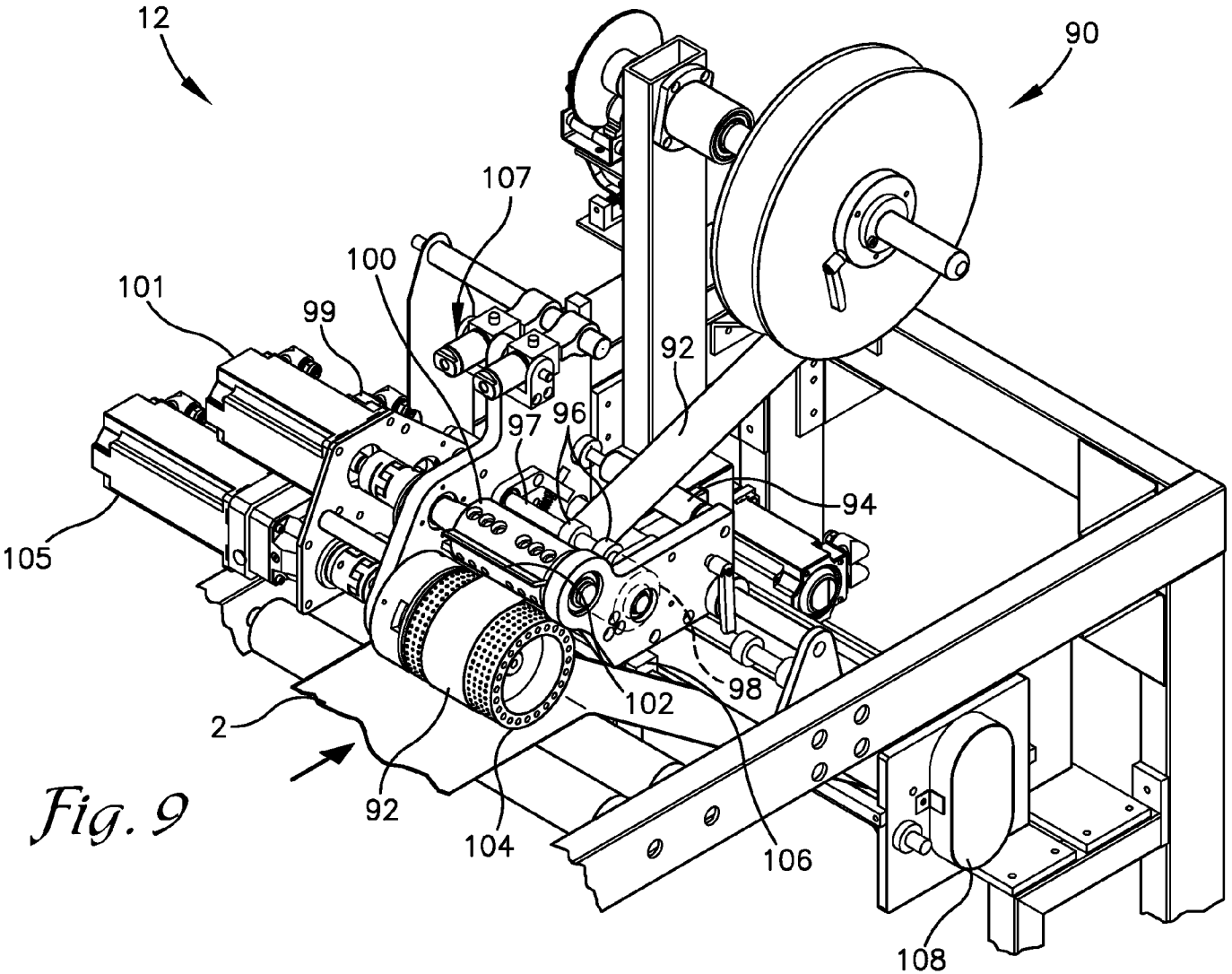
FIG. 9 is an enlarged perspective view of the patch applicator assembly shown in FIG. 1.

The web advances from the cutting assembly 8 to the adhesive application assembly 10 and under a first gummer roller 80. The web next passes upwardly, past a window gummer sensor 82 and a window patch sensor 84 to a pair of elevated gummer feed rollers 86, 87 that are positioned in spaced relation to pass the web beneath the applicator nozzles 78*a*, 78*b*, 78*c* and 78*d*. The surface feed sensor 48 of the infeed nip assembly 6 signals the gummer controller 88 information regarding the speed of the web 2. The gummer position sensor 82 is an optical sensor that reads the location of the leading edge of the window aperture and sends an electrical signal to the gummer controller 88 indicating the location of the window. The web speed and window location signals prompt the gummer controller 88 to calculate the position for application of the gum. As the web passes under the gum head the gummer controller 88 actuates the solenoids 81*a*, 81*b*, 81*c*, and 81*d* to open the valves to the air supply lines 79*a*, 79*b*, 79*c*, and 79*c*, which actuate the nozzles 78*a*, 78*b*, 78*c*, and 78*d* and allows gum to flow from the nozzles under pressure according to a predetermined pattern through holes in a template or shim (not shown). The template includes a plurality of lanes configured to direct adhesive supplied by the nozzles 78*a*, 78*b*, 78*c* and 78*d* in an open pattern in closed spaced relation to the outer perimeter margin of the window opening. It is also foreseen that the adhesive may be applied on or in contacting relation with the perimeter margin of the window aperture. For example, in a slot coating process, the controller 88 may simultaneously actuate the two outboard valves to nozzles 78*a* and 78*d* to apply adhesive along the long sides of the rectangle and actuate the inboard valves to nozzles 78*b* and 78*c* to apply adhesive in a pulse along the short side of the rectangle. Next, the gummer controller 88 may actuate the inboard valves 78*b* and 78*c* in a pulse to apply adhesive along the remaining short side of the rectangle. In this manner, actuation of the solenoids by the controller cooperates to apply the adhesive in an open rectangular pattern that completely surrounds the window aperture. The web 2 exits the gumming assembly 10 over the second gummer feed roller 87 and proceeds to the patch application assembly 12, which is best shown in FIG. 9.

The patch application assembly 12 includes a patch roll stand 90 having a spindle for supporting a continuous web roll of patch material or window film 92. The roll stand 90 is mounted to discharge the window web 92 in the opposite direction of travel of the envelope web 2. The window web advances from the roll and beneath an infeed roller 94, then between a pair of upper nip rollers 96, which are mounted on a nip roller shaft 97, and lower driven window film infeed roller 98. A servo motor 99 drives the infeed roller 98 at a rate of speed which is controlled to feed the patch web material at a selected rate necessary to achieve the desired patch length. The window film 92 next advances to a rotary knife 100 driven by a servo motor 101 and equipped with a blade 102 for cutting the patch to the desired length on each revolution of the knife 100. As previously described, the window patch positioning sensor 84 located on the frame of the gumming assembly 10 optically senses the leading edge of each window aperture prior to application of gum to the perimeter of the window and transmits a signal to the control system 16. The control system 16 includes a database with data previously entered via the user interface regarding the length of the window apertures in the direction of the web as well as a pre-selected measurement for a desired patch overlap on the web 2 in the area around the window. Based on these two measurements, the control system 16 orders the servo motor 99 to drive the window film infeed roller 98 at a calculated speed that is necessary to rotate the knife blade 100 to enable the blade 102 to cut the film 92 to the predetermined length on each revolution.

Continued rotation of the rotary knife 100 delivers the patches to a vacuum patch application cylinder 104, which is positioned in offset inferior relation to the rotary knife 100 and driven by a servo motor 105. The vacuum cylinder 104 picks up the patch after it has been cut or separated from the window web and holds it on the cylinder as it rotates in the same manner as the magnetic vacuum cylinder 58 hold the window patch. As the cylinder 104 rotates over the paper web 2 it deposits the window patch in registration with the adhesive template on the paper web 2. As previously described, the surface speed sensor 48 of the infeed nip assembly 6 continuously transmits the rate of speed of the web to the control system 16. The control system 16 processes this information and instructs the servo motor 105 to drive the patch application cylinder 104 at a rate of speed calculated by the control system to be equal to the speed of advancement of the envelope web 2 from the opposite direction. In this manner, wrinkling of the patch during application to the web 2 is avoided. Advantageously, use of servo motors in the patch application assembly 12 instead of conventional gear driven motors allows the length of the patch to be infinitely adjusted to accommodate a wide variety of window sizes.

A window patch sensor 106 is positioned to optically verify the presence of window film 92 on the film-input side of the patch applicator cylinder 104. This sensor 106 continuously communicates with the control system 16 during operation of the patch applicator 104. If the sensor 106 transmits a negative signal, the control system 16 immediately instructs actuation of a pneumatic disconnect assembly 107 to raise the entire patch application assembly 12 above the web 2 and to cause the infeed nip assembly 6 to stop the web 2. In this manner, the control system 16 operates to prevent the glue surrounding the unpatched windows from fouling the patch applicator assembly 12, buffer assembly 14 and any other downstream apparatus.

Figure 11:
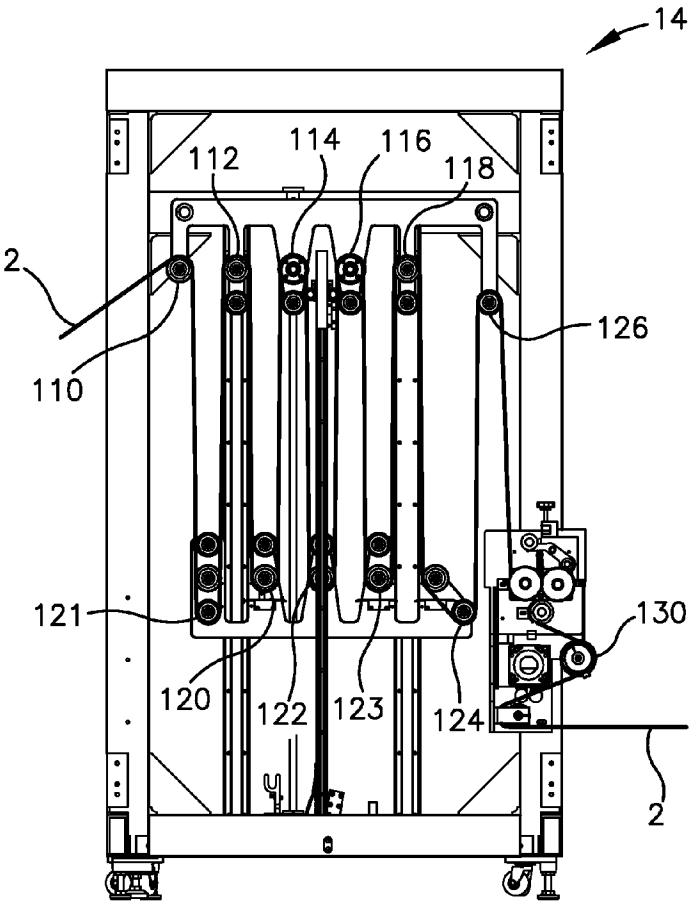
FIG. 11 is a front elevational view of the buffer assembly shown in FIG. 10 showing the upper and lower rollers in spaced apart relation.
Figure 10:
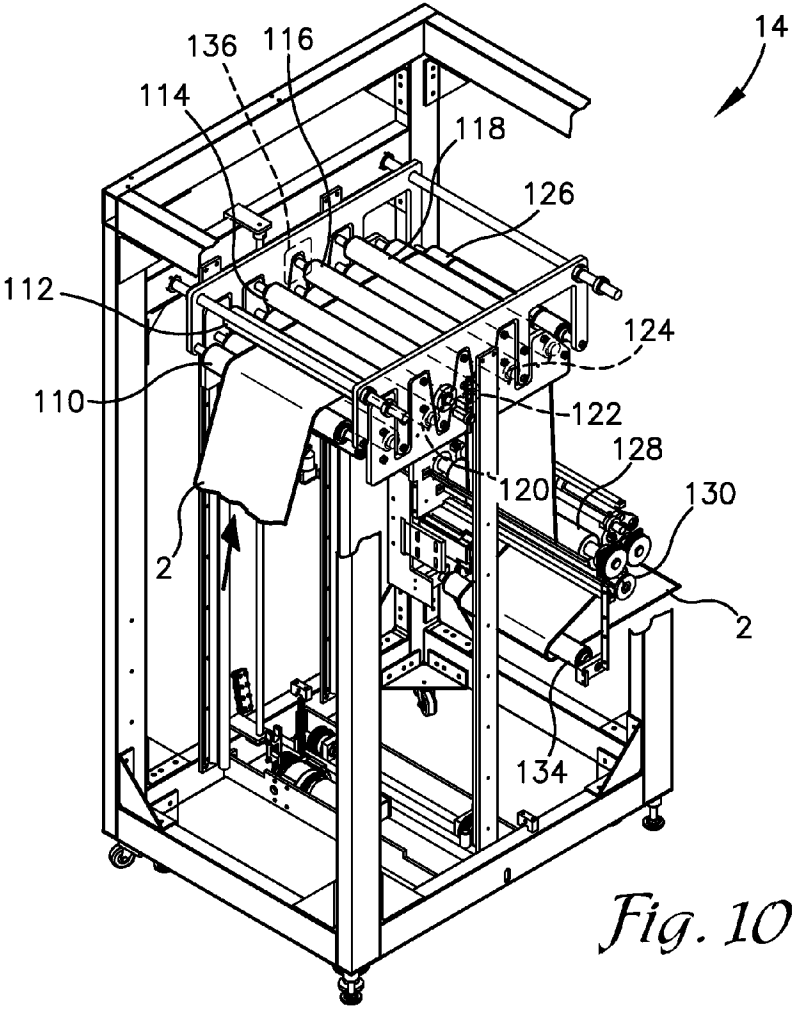
FIG. 10 is an enlarged perspective view of the buffer assembly shown in FIG. 1, with parts broken away and some upper and lower rollers omitted for clarity.

The buffer assembly or festoon 14 receives the converted web 2 as it advances from the patch application assembly 12 and accumulates quantities of the web as necessary to adjust the web output to match, but not exceed, the receiving capacity of subsequent web processing apparatus or systems. As shown in FIG. 9, the buffer assembly 14 includes a festoon nip assembly 108 that is positioned to receive the patched web 2 as it exits the patch application assembly 12. As best shown in FIGS. 10 and 11, the web passes from the festoon nip assembly 108 to a series of fixedly mounted upper rollers 110, 112, 114, 116, and 118 and a corresponding plurality of movably mounted lower or dancer rollers 120, 121, 122, 123 and 124. A festoon exit roller 126 is positioned adjacent the last upper roller 118. An idler roller 128 is positioned after the festoon exit roller 126 and in advance of a web tension transducer roller 130, followed by a web or paper exit roller 134.

The web 2 advances from the patch application assembly 12 and passes through the festoon nip assembly 108, over the first upper roller 110, under the first dancer roller 120 and continues in this manner over rollers 114, 116 and under rollers 122 and 124 until it is entrained between all of the upper and lower rollers. The dancer rollers 120, 122 and 124 are mounted for vertical shifting movement upwardly and downwardly in response to the weight of the web 2 as shown in FIGS. 10 and 11. In another embodiment, the lower rollers may be mounted as fixed rollers and the upper rollers may be movable or dancing rollers. In still another embodiment, the fixed and movable rollers are mounted in opposed relation on opposite sidewalls of the buffer assembly 14, so that the entrained web 2 extends generally horizontally between them.

Figure 13:
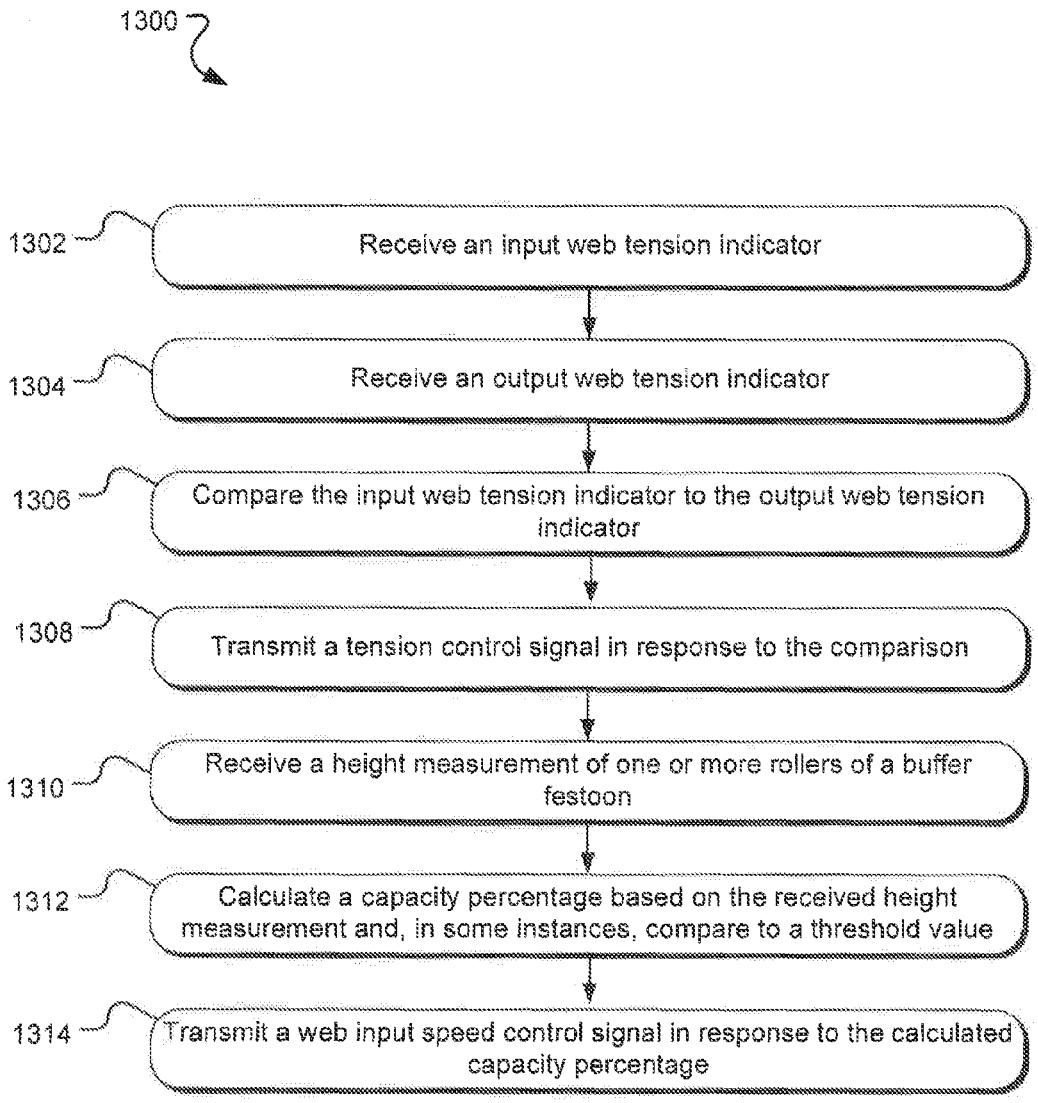
FIG. 13 is a flowchart of a method for controlling a window profiling system.

With reference to the method 1300 illustrated in FIG. 13, the control system 16 modulates the speed of the festoon nip assembly 108 based on information from the load cell 46 and the buffer transducer 130. As the web exits the upstream infeed nip assembly 6, the load cell 46 measures and communicates web tension to the control system 16 (operation 1302). The control system 16 may actuate the festoon nip assembly 108 to run faster to pull more web and thereby raise the tension on the web, or it may command the nip assembly 108 to run at a slower speed to reduce tension on the web. The transducer roller 130 in the buffer assembly 14 measures the web tension applied on the output side of the buffer assembly 14 by downstream elements such as a wrapper, inserter, rewind, printer, cutter, packaging module or other apparatus, and transmits this information to the control system 16 (operation 1304). When the speed of the web 2 entering the buffer assembly 14 exceeds the speed at which the web can exit the buffer 12 via the web exit roller 134 (operation 1306), the increased weight of the web acts to lower the dancer rollers by gravity toward the position shown in FIG. 11. When the speed of the web exiting the festoon exceeds the speed at which the web enters, then the dancers are pulled upwardly toward the position shown in FIG. 10. As mentioned above, the control system 16 in operation 1308 may actuate the festoon nip assembly 108 to run faster to pull more web and thereby raise the tension on the web, or it may command the nip assembly 108 to run at a slower speed to reduce tension on the web.

A potentiometer 136 is mounted on the frame at the end of the shaft of one of the upper rollers and is connected to the corresponding lower dance roller by a belt. The potentiometer measures the height of the lower dancer rollers and communicates this information to the control system 16 (operation 1310). The control system 16 processes this information (operation 1312) and transmits instructions to the festoon nip assembly 108 and infeed nip assembly 6 to slow the web when the buffer assembly 14 approaches maximum capacity (operation 1314). If modulation of the speed of the web 2 by the control system is insufficient to prevent the buffer system from reaching maximum capacity, the control system 16 signals the infeed nip assembly 6 to bring the web to a halt.

This control function is particularly advantageous when the web must pass from the buffer assembly 14 to a wrapper, inserter with accumulator or other downstream assembly that handles a variable numbers of pages for insertion into an envelope formed from the converted web. Such accumulations are subject to frequent stops and starts to wait for accumulation of the pages of the insert. By accumulating lengths of the converted web within the festoon buffer, the present system minimizes the need for stoppage of either the envelope profiling system 1 or the apparatus of the next system, such as an accumulator, and reduces hesitation in feeding the continuous, windowed web. It is foreseen that, when the upper rollers are movable, the potentiometer 136 would be mounted adjacent one of the lower rollers. In one embodiment, one or more sensors are mounted in one or more suitable locations to measure the change in distance between the upper and lower rollers.

In use, a roll of continuous web envelope stock is mounted on the roll stand 18 for unrolling and advancement to the web alignment assembly 4. A series of sensors in the web aligner 4 measure the position of the web and transmit positional information to an internal guidance system in the aligner 4, which calculates variance from a norm and adjusts the position of the web as necessary. The web is passed to the infeed nip assembly 6 which includes a surface speed sensor 48 and cue mark sensor 50. The web is next passed to a load cell 46 having a web tension pressure transducer. The surface speed sensor communicates with a controller of the gumming assembly 10. The cue mark sensor transmits information to the control system 16. The web next advances to the cutting station 8 which cuts trims the seal flap profile and window aperture in predetermined locations on the web. The web next advances to the gumming assembly 10, which includes a gummer controller 88 that is independent of the control system 16. The gummer controller includes a window gummer sensor 82 that communicates with the gummer controller 88. A window patch sensor 84 is mounted on the gumming assembly 10 and communicates with the control system 16. The web next advances to the patch applicator 12, where data from the infeed nip assembly 6 is used by the control system to control the servo motor 99 that drives the window film infeed roller 98 at the correct rate of speed to feed an appropriate length of web patch material and to control the servo motor 101 that drives the rotary knife 100 to cut the patch with rotating blade 102. The window patch applied, the web advances to the buffer assembly 14, where data transmitted from the infeed nip assembly 6, output web tension transducer 130, and potentiometer 136 are used to control the speed of the web entering the system via the infeed nip assembly 6 for use in controlling accumulation of the web in the festoon. In one embodiment of the system, the web alignment assembly 4 communicates with and is controlled by the control system 16. In one embodiment of the system 1, the adhesive application assembly 10 communicates with and is controlled by the control system 16. In one embodiment of the system, both the web aligner 4 and the adhesive application assembly 10 communicate with and are controlled by the control system.

In one exemplary embodiment of the festoon operation illustrated in the method 1300 of FIG. 13, when the control system calculates that the festoon is about 50% full, the web output moves at a 1:1 rate of speed with the downstream station such as a wrapper. As the output from the buffer assembly slows, the lower dancer rollers move apart from the upper fixed rollers and the festoon begins to fill with web. Based on input from the potentiometer, 136, the control system calculates available capacity of the buffer 14. When the control system 16 calculates that the buffer 14 is about 70% full, it signals the upstream infeed nip assembly 6 to reduce the speed of the web 2. As the festoon fills to about 90%, the control system 16 instructs the infeed nip assembly 6 to come to a controlled stop, so that the operations of the cutting assembly 8, adhesive application assembly 10 and patch application assembly 12 are in a resting phase and not interrupted by the stoppage. In this manner, the control system 16 uses the capacity of the buffer system as a measure for coordination of the various stations to control the speed of the web 2 and output of the system. By achieving a controlled stop before full capacity is reached and a sudden stop becomes necessary, the control system avoids expensive spoilage of envelope blanks that would otherwise be caused by interrupting the cutting, gluing and patch application operations. In one embodiment, the benchmark goal is to operate the buffer assembly at about 50% of capacity. In another embodiment, When the control system calculates that the festoon is about 25% full, it instructs the upstream assemblies of the profiling system to speed up.

Those skilled in the art will appreciate that in other exemplary embodiments of the festoon operation, when the control system calculates that the festoon is about 10% to about 90% full, or about 20% to about 80% full, or about 30% to about 70% full, or about 40% to about 60% full, or about 45% to about 55% full, or any other suitable capacity, the web output moves at a 1:1 rate of speed with the downstream station such as a wrapper. In other exemplary embodiments, when the control system 16 calculates that the buffer 14 is about 10% to about 90% full, or about 20% to about 80% full, or about 30% to about 70% full, or about 40% to about 60% full, or about 50% full, or any other suitable percentage of capacity, it signals the upstream infeed nip assembly 6 to reduce the speed of the web 2. In other exemplary embodiments, as the festoon fills to about 50% to about 100%, or about 60% to about 100%, or about 70% to about 100% or about 80% to about 100%, or about 85% to about 95%, or any other suitable percentage of capacity, the control system 16 instructs the infeed nip assembly 6 to come to a controlled stop. Also, in other exemplary embodiments, the benchmark goal is to operate the buffer assembly at from about 10% to about 90%, or about 20% to about 80%, or about 30% to about 70% or about 40% to about 60% or about 45% to about 50%, or any other suitable percentage of capacity. In other exemplary embodiments, when the control system calculates that the festoon is from about 0% to about 70% or about 5% to about 60% or about 10% to about 50% or about 15% to about 40% or about 20% to about 30% full, it instructs the upstream assemblies of the profiling system to speed up.

In one embodiment, the computer control system 16 utilizes instructions stored in a computer readable medium 202 for performing one or more of the operations discussed herein. In particular, the control system 16 may include one or more processors 204 for executing one or more computer-readable programs. To facilitate the described operations, the components may also include a memory controller 206 for interfacing a main memory 202 with the one or more processors 204 for retrieving information, such as instructions of a program, and/or storing information used by the system 16. The system 16 may also include an input/output (I/O) interface 208 to interface I/O devices 210, 212 with the processors 204. I/0 devices may also include an input device 138 (FIG. 1), such as an alphanumeric input device 210, including alphanumeric and other keys for communicating information and/or command selections to the processors. Another type of user input device includes cursor control, such as a mouse 212, a trackball, or cursor direction keys for communicating direction information and command selections to the processors 204 and for controlling cursor movement on the display device.

The control system 16 may include a dynamic storage device, referred to as main memory 202, or a random access memory (RAM) or other computer-readable devices for storing information and instructions to be executed by the processors 204. Main memory 202 also may be used for storing temporary variables or other intermediate information during execution of instructions by the processors 204. In addition, the control system 16 may be connected to a network 214 through one or more network communication ports 216 to provide information or receive information to the network. In one embodiment, the network 214 is the Internet and the network communication port 216 includes an Internet modem. As described herein, the control system 16 may receive information, such as the various signals provided by the one or more sensors, which may be used by the control system during the described operations to monitor the performance of the system and adjust the various performance parameters accordingly.

The system 1 as depicted and described herein is configured, when viewed from above, in a generally linear arrangement and, when viewed from the side, with the gumming and patch application assemblies elevated to facilitate entry of the web 2 into the upper portion of the taller buffer assembly 14. Those skilled in the art will appreciate that the system 1 may also be configured in any other suitable angular or curved orientation and that it may also be configured with the assemblies positioned at any appropriate height or combination of heights.

It is to be understood that while certain forms of the window profiling system have been illustrated and described herein, the invention is not to be limited to the specific forms or arrangement of parts described and shown.

The following is claimed and desired to be secured by Letters Patent:

1. A method for controlling the output rate of a web of an envelope processing apparatus, the method comprising:

a. receiving, at a control system, an input web tension indicator from an upstream infeed nip assembly, the upstream infeed nip assembly configured to pull web in an envelope processing apparatus;

b. receiving, at the control system, an output web tension indicator from a transducer device at the output of the envelope processing apparatus, the transducer device configured to measure the tension on a web provided to at least one downstream envelope processing component by a buffer assembly;

c. comparing the received input web tension indicator and the received output web tension indicator;

d. transmitting a tension control signal from the control system, the tension control signal configured to actuate a roller assembly located between the upstream infeed nip assembly and the transducer device to adjust the tension of the web in response to comparing the received input web tension indicator and the received output web tension indicator;

e. receiving, at the control system, a height measurement of one or more rollers of a buffer festoon component of the envelope processing apparatus, the height measurement indicative of an amount of web maintained within the buffer festoon component;

f. utilizing the control system to calculate a capacity percentage of the web of the envelope processing apparatus buffered in the buffer component; and g. transmitting a web input speed control signal from the control system based on the calculated capacity percentage of the web of the envelope processing apparatus buffered in the buffer component, the input speed control signal configured to adjust the input speed of the web into the upstream infeed nip assembly configured to pull web in an envelope processing apparatus.

2. The method of claim 1 wherein the control signal is configured to decrease the rotation speed of the roller assembly when the received output web tension indicator is greater than the received input web tension indicator.

3. The method of claim 1 wherein the control signal is configured to increase the rotation speed of the roller assembly when the received output web tension indicator is less than the received input web tension indicator.

4. The method of claim 1 wherein the transmitting the web input speed control signal operation comprises:

a. comparing the calculated capacity percentage of the web of the envelope processing apparatus buffered in the buffer component to a threshold value; and b. transmitting the web input speed control signal from the control system to the upstream infeed nip assembly if the calculated capacity percentage of the web of the envelope processing apparatus buffered in the buffer component to a threshold value is greater than the threshold value.

5. The method of claim 4 wherein the web input speed control signal from the control system is configured to reduce the speed of the input of the web into the upstream infeed nip assembly if the calculated capacity percentage of the web of the envelope processing apparatus buffered in the buffer component is greater than the threshold value.

6. The method of claim 4 wherein the threshold value is 90% and the web input speed control signal from the control system is configured to stop the input of the web into the upstream infeed nip assembly configured to pull web in an envelope processing apparatus.

7. The method of claim 4 wherein the threshold value is about 70%.

8. The method of claim 4 wherein the calculated capacity percentage is within 85% to 95% and the web input speed control signal from the control system is configured to stop the input of the web into the upstream infeed nip assembly configured to pull web in an envelope processing apparatus.

9. A control system for controlling the output rate of a web of an envelope processing apparatus, the control system comprising:

a processor; and a non-transitory computer readable medium with one or more executable instructions stored thereon, wherein the processor executes the one or more instructions to perform the operations of:

a. receiving an input web tension indicator from an upstream infeed nip assembly, the upstream infeed nip assembly configured to pull web in an envelope processing apparatus;

b. receiving an output web tension indicator from a transducer device at the output of the envelope processing apparatus, the transducer device configured to measure the tension on a web provided to at least one downstream envelope processing component by a buffer assembly;

c. comparing the received input web tension indicator and the received output web tension indicator;

d. transmitting a tension control signal, the tension control signal configured to actuate a roller assembly located between the upstream infeed nip assembly and the transducer device to adjust the tension of the web in response to comparing the received input web tension indicator and the received output web tension indicator;

e. receiving a height measurement of one or more rollers of a buffer festoon component of the envelope processing apparatus, the height measurement indicative of an amount of web maintained within the buffer festoon component;

f. calculating a capacity percentage of the web of the envelope processing apparatus buffered in the buffer component; and g. transmitting a web input speed control signal based on the calculated capacity percentage of the web of the envelope processing apparatus buffered in the buffer component, the input speed control signal configured to adjust the input speed of the web into the upstream infeed nip assembly configured to pull web in an envelope processing apparatus.

10. The control system of claim 9 wherein the control signal is configured to decrease the rotation speed of the roller assembly when the received output web tension indicator is greater than the received input web tension indicator.

11. The control system of claim 9 wherein the control signal is configured to increase the rotation speed of the roller assembly when the received output web tension indicator is less than the received input web tension indicator.

12. The control system of claim 9 wherein the processor transmitting the web input speed control signal operation comprises:

a. comparing the calculated capacity percentage of the web of the envelope processing apparatus buffered in the buffer component to a threshold value; and b. transmitting the web input speed control signal to the upstream infeed nip assembly if the calculated capacity percentage of the web of the envelope processing apparatus buffered in the buffer component to a threshold value is greater than the threshold value.

13. The control system of claim 12 wherein the web input speed control signal is configured to reduce the speed of the input of the web into the upstream infeed nip assembly if the calculated capacity percentage of the web of the envelope processing apparatus buffered in the buffer component is greater than the threshold value.

14. The control system of claim 12 wherein the threshold value is 90% and the web input speed control signal is configured to stop the input of the web into the upstream infeed nip assembly configured to pull web in an envelope processing apparatus.

15. The control system of claim 12 wherein the threshold value is about 70%.

16. The control system of claim 12 wherein the calculated capacity percentage is within 85% to 95% and the web input speed control signal is configured to stop the input of the web into the upstream infeed nip assembly configured to pull web in an envelope processing apparatus.

* * * * *